US005584186A

United States Patent [19]

Hirano

[11] Patent Number: 5,584,186

[45] Date of Patent: Dec. 17, 1996

[54] REFRIGERANT CIRCUIT FOR ICE MAKING MACHINE ETC.

[75] Inventor: Akihiko Hirano, Aichi, Japan

[73] Assignee: Hoshizaki Denki Kabushiki Kaisha, Aichi, Japan

[21] Appl. No.: 342,725

[22] Filed: Nov. 21, 1994

[51] Int. Cl.[6] ..... F25B 41/04

[52] U.S. Cl. ..... 62/196.4; 62/352; 62/278

[58] Field of Search ..... 62/151, 196.4, 62/278, 352, DIG. 17

[56] References Cited

U.S. PATENT DOCUMENTS 3,464,226 9/1969 Kramer ..... 62/278

4,437,317 3/1984 Ibrahim ..... 62/DIG. 17

*Primary Examiner*—Harry B. Tanner

*Attorney, Agent, or Firm*—Koda and Androlia

[57] ABSTRACT

Disclosed is a refrigerant circuit for ice making machines and the like, the circuit comprising a freezing circuit in which a high-pressure and high-temperature vaporized refrigerant is fed from a compressor through a solenoid valve to a condenser, the refrigerant liquefied in the condenser is then fed to an expansion means, the refrigerant vaporized through the expansion means is further fed to an evaporator, and the vaporized refrigerant heated through heat exchange is fed back to the compressor; and a hot gas circuit which bypasses the high-pressure and high-temperature vaporized refrigerant fed from the compressor to the evaporator through a hot gas valve so as to achieve ice releasing and the like at the evaporator; the solenoid valve and the hot gas valve being designed to be let open and closed, respectively, during the freezing operation, and to be closed and let open, respectively, when the operation mode is switched to the ice releasing operation; wherein a pressure detecting means is interposed between the compressor and the solenoid valve so as to achieve control of opening and closing the solenoid valve during the ice releasing operation and the like by the pressure detecting means. In the thus constituted circuit, drop in the performance, and burning or damage of the compressor can successfully be prevented.

2 Claims, 3 Drawing Sheets

REFRIGERANT CIRCUIT FOR ICE MAKING MACHINE ETC.

BACKGROUND OF THE INVENTION

This invention relates to a refrigerant circuit for an ice making machine and the like, in which, when a high-pressure and high-temperature vaporized refrigerant is fed from a compressor to an evaporator so as to release the ice formed on ice making plates and the like, drop in the performance of the compressor and occurrence of troubles in the compressor are designed to be prevented by reducing, as necessary, the pressure on the refrigerant outlet side of the compressor.

An ice making machine for making automatically a number of ice pieces has a freezing circuit for circulating a refrigerant, in which the ice making plates are designed to be heated by feeding a high-pressure and high-temperature vaporized refrigerant (hereinafter sometimes referred to as hot gas) from a compressor to an evaporator attached to the ice making plates, upon switching from a freezing operation to an ice releasing operation, to accelerate releasing of the ice pieces formed on the ice making plates. For example, FIG. 3 shows a flow-down system ice making machine, in which water to be frozen is sprinkled against ice making plates standing perpendicularly to form ice pieces continuously thereon. In this type of ice making machine, an evaporator 14 led out of a freezing circuit 12, shown in FIG. 4, running zigzag in the transverse direction is secured in closed contact between a couple of ice making plates 10 disposed perpendicularly, and a refrigerant is circulated during a freezing operation to forcibly cool these ice making plates 10. A plurality of vertical elongated ridges 10*a* are arranged on the freezing surface of each ice making plate 10 in the transversal direction, and ice pieces 16 are designed to be formed between every two adjacent ridges 10*a* at the positions where the evaporator 14 runs. A slanted water collecting plate 18 having a plurality of through holes 18*a* is disposed immediately below the ice making plates 10, and the portion of the water to be frozen which, was fed to the ice making plates 10 during the freezing operation but failed to freeze is dripped through the through holes 18*a* to be recovered and stored in a water tank 20 locating below the water collecting plate 18. Incidentally, the water collecting plate 18 also serves to guide the ice pieces 16 released under an ice releasing operation and dropped thereto into an ice bin 22 disposed diagonally below the water collecting plate 18.

A water supply pipe 26 led out of the water tank 20 through a circulating pump 24 is connected to a sprinkler 28 disposed above the ice making plates 10 and on the freezing surface sides thereof. A plurality of water distribution holes (not shown) are formed in this sprinkler 28, and the water to be frozen pumped from the tank 20 during the freezing operation is designed to be sprinkled through these water distribution holes onto the freezing surfaces of the ice making plates 10 cooled to the freezing point and to flow down therealong, whereby to form ice pieces 16 having a predetermined shape on the freezing surfaces.

FIG. 4 shows schematically a constitution of the freezing circuit to be suitably employed in the above-described automatic ice making machine. The freezing circuit 12 essentially has a compressor 30 for compressing a refrigerant such as Freon (a fluorinated hydrocarbon) a condenser 32 to which the high-pressure and high-temperature vaporized refrigerant obtained after compression in the compressor 30 is fed, an expansion valve 34 to which the refrigerant condensed to be liquefied in the condenser 32 is fed and an evaporator 14 to which the refrigerant expanded to be vaporized through the expansion valve 34 is fed. The evaporator 14 performs heat exchange with the refrigerant expanded and vaporized through the expansion valve 34 so as to cool the ice making plates 10 attached to the evaporator 14 below the freezing point and allow the water to be frozen flowing down along the ice making plates 10 to freeze gradually. The vaporized refrigerant heated after heat exchange in the evaporator 14 is fed back to the compressor 30, compressed to a high pressure and a high temperature and then recirculated. Incidentally, the reference number 36 denotes a detecting means for detecting the temperature of the refrigerant on the refrigerant outlet side of the evaporator 14, and the detecting means 36 is designed to perform aperture control of the expansion valve 34.

A pipe 38 branching out of a pipe 37 located on the outlet side of the compressor 30 is connected through a hot gas valve 40 such as a solenoid valve to the inlet side of the evaporator 14 to constitute a so-called hot gas circuit 42. The hot gas valve 40 is closed during the freezing operation to interrupt circulation of the refrigerant through the hot gas circuit 42 and to circulate the refrigerant to the freezing circuit 12 only. Meanwhile, when the ice releasing operation for releasing and dropping the ice pieces is started after completion of the freezing operation at the ice making plates 10, the hot gas valve 40 is let open to allow a hot refrigerant (hot gas) to circulate through the hot gas circuit 42. Thus, the ice making plates 10 attached to the evaporator 14 are heated to release adhesion of the ice pieces 16 formed on these ice making plates 10 and allows them to drop by their own weight.

As described above, when the operation mode of the ice making machine is switched to the ice releasing operation, the hot gas valve 40 is changed over from the closed posture to the open posture (1) to interrupt circulation of the refrigerant through the freezing circuit 12 and (2) to feed the high-pressure and high-temperature vaporized refrigerant from the outlet side of the compressor 30 to the evaporator 14. However, as shown in FIG. 4, no closing means such as a valve is disposed to the inlet side of the condenser 32. Accordingly, the hot gas delivered from the compressor 30 during the ice releasing operation is not entirely fed to the hot gas circuit 42, but the substantial portion of the hot gas is designed to be circulated through the hot gas circuit 42. The small portion of the hot gas flows into the condenser 32 where the heat of the hot gas is dissipated well, and the hot gas is liquefied and stays therein (this phenomenon is termed as "stagnation"). If some portion of the hot gas stagnates in the freezing circuit 12 connected to the condenser 32, the hot gas to be circulated through the hot gas circuit 42 decreases with time corresponding to the amount of stagnation. It can thus be pointed out that the ice releasing performance in the evaporator 14 is gradually lowered to require a considerable time for the ice releasing operation, disadvantageously. Such problem occurs conspicuously when the ambient temperature is low. Incidentally, in the freezing circuit of the system in which a receiver is provided on the outlet side of the condenser 32, the-amount of stagnated hot gas is increased, so that the ice releasing performance is further lowered.

In the above ice making machine, the temperature rise at the ice making plates 10 brought about by the dropping of the ice pieces 16 therefrom by the ice releasing operation is designed to be detected by a thermostat (not shown) so as to switch the operation mode from the ice releasing operation to the freezing operation. When the amount of the hot gas circulated through the hot gas circuit 42 is decreased due to the reason described above, the ice pieces 16 formed on the ice making plates 10 fail to be released evenly, but those ice pieces 16 formed near the thermostat occasionally drop sooner. In such cases, the operation mode is switched from the ice releasing operation to the freezing operation, although the ice pieces 16 formed at the other portions have not yet been dropped, leading to double-freezing, disadvantageously.

A countermeasure for such problem is proposed, in which a solenoid valve 44 is disposed, as shown in FIG. 5, on the downstream side (on the condenser (32) side), with respect to the flow of the refrigerant, than the junction of the pipe 38 with the pipe 37 connecting the compressor to the condenser 32. Namely, during the freezing operation, the solenoid valve 44 is let open to allow the refrigerant to circulate through the freezing circuit 12, and also the hot gas valve 40 is closed to interrupt circulation of the refrigerant through the hot gas circuit 42. Meanwhile, when the operation mode is switched from the freezing operation to the ice releasing operation, the solenoid valve 44 is closed to interrupt circulation of the refrigerant through the freezing circuit 12, and also the hot gas valve 40 is let open to allow the heated refrigerant (hot gas) to circulate through the hot gas circuit 42. Thus, the hot gas delivered from the compressor 30 during the ice releasing operation is entirely fed to the hot gas circuit 42 so as to prevent drop in the ice releasing performance, enabling reduction of the time required for the ice releasing operation.

However, if the solenoid valve 44 is closed when the operation mode of the ice making machine is switched to the ice releasing operation and the ice releasing operation is continued in such state, the pressure on the outlet side of the compressor 30 sometimes increases greatly. Namely, upon mode switching from the freezing operation to the ice releasing operation, the hot gas valve 40 is let open to swiftly lower the pressure on the outlet side of the compressor 30, and the pressure on the inlet side of the evaporator 14 is increased. The reason is that the aperture of the hot gas valve 40 is set relatively great, and the solenoid valve 44 is closed simultaneously or with a predetermined time lag to allow a large amount of hot gas to circulate through the hot gas circuit 42 only. At the initial and intermediate stages of the ice releasing operation, a number of ice pieces 16 adhere firmly onto the ice making plates 10, and even if a large amount of hot gas is circulated through the evaporator 14, the heat is consumed for melting the frozen surface between the ice pieces 16 and each of the ice making plates 10. Meanwhile, the pressure on the inlet side of the evaporator 14 is elevated by the hot gas already flowed thereto in a large amount, so that the hot gas is not only cooled but also liquefied (e.g., in the case of Freon R-22, it is condensed at 0° C. or higher, if the pressure exceeds 4 kg f/cm$^2$G) and fed back as such to the compressor 30, and thus the refrigerant repeats the cycle described above.

At the final stage of the ice releasing operation, since most of the ice pieces 16 are released from the ice making plates 10, the temperature drop of the hot gas to be brought about by the heat exchange becomes small, and the amount of liquefied hot gas is reduced to increase the pressure at the inlet side of the evaporator 14. Accordingly, the delivery of the hot gas from the compressor 30 increases, so that the pressure on the outlet side of the compressor 30 is increased. Namely, the cycle that the pressure on the inlet side of the evaporator 14 and the pressure on the outlet side of the compressor 30 are increased acceleratively by the increased amount of the hot gas passing through the hot gas valve 40 is repeated (sometimes to extremely high values, e.g., 7 kg f/cm$^2$G on the inlet side of the evaporator 14; 23 kg f/cm$^2$G on the outlet side of the compressor 30). If the pressure on the outlet side of the compressor 30 is thus increased, drop in the performance is caused due to the load applied to the compressor 30, and accidents such as burning, damage, etc. are liable to occur.

Incidentally, since the temperature at which the refrigerant is liquefied becomes higher as the pressure is increased, the refrigerant is easily liquefied at the final stage of ice releasing operation due to the rise of the pressure in the condenser 33 in the freezing circuit shown in FIG. 4, as described above, and thus the amount of stagnated refrigerant is much greater.

This invention is proposed in view of the problems inherent in the prior art refrigerant circuits for ice making machines and the like, as described above, and in order to overcome them successfully, and it is an objective of the invention to provide a means which can prevent drop in the performance of the compressor or occurrence of burning etc. when the ice pieces grown on the ice making plates and the like are to be released by circulating a hot vaporized refrigerant (hot gas) to the evaporator.

SUMMARY OF THE INVENTION

In order to overcome the above problems and attain the intended object suitably, this invention provides a refrigerant circuit for ice making machines and the like, the circuit comprising a freezing circuit in which a high-pressure and high-temperature vaporized refrigerant obtained after compression in a compressor is fed through a solenoid valve to a condenser, the refrigerant condensed to be liquefied in the condenser is then fed to an expansion means, the refrigerant expanded to be vaporized through the expansion means is further fed to an evaporator, and the vaporized refrigerant heated through heat exchange is fed back to the compressor; and a hot gas circuit which bypasses the high-pressure and high-temperature vaporized refrigerant fed from the compressor to the evaporator through a hot gas valve so as to achieve ice releasing and the like at the evaporator; the solenoid valve and the hot gas valve being designed to be let open and closed, respectively, during the freezing operation, and to be closed and let open, respectively, when the operation mode is switched to the ice releasing operation; wherein a pressure detecting means is interposed between the compressor and the solenoid valve so as to achieve control of opening and closing the solenoid valve during the ice releasing operation and the like by the pressure detecting means.

DETAILED DESCRIPTION OF THE INVENTION

Figure 3:
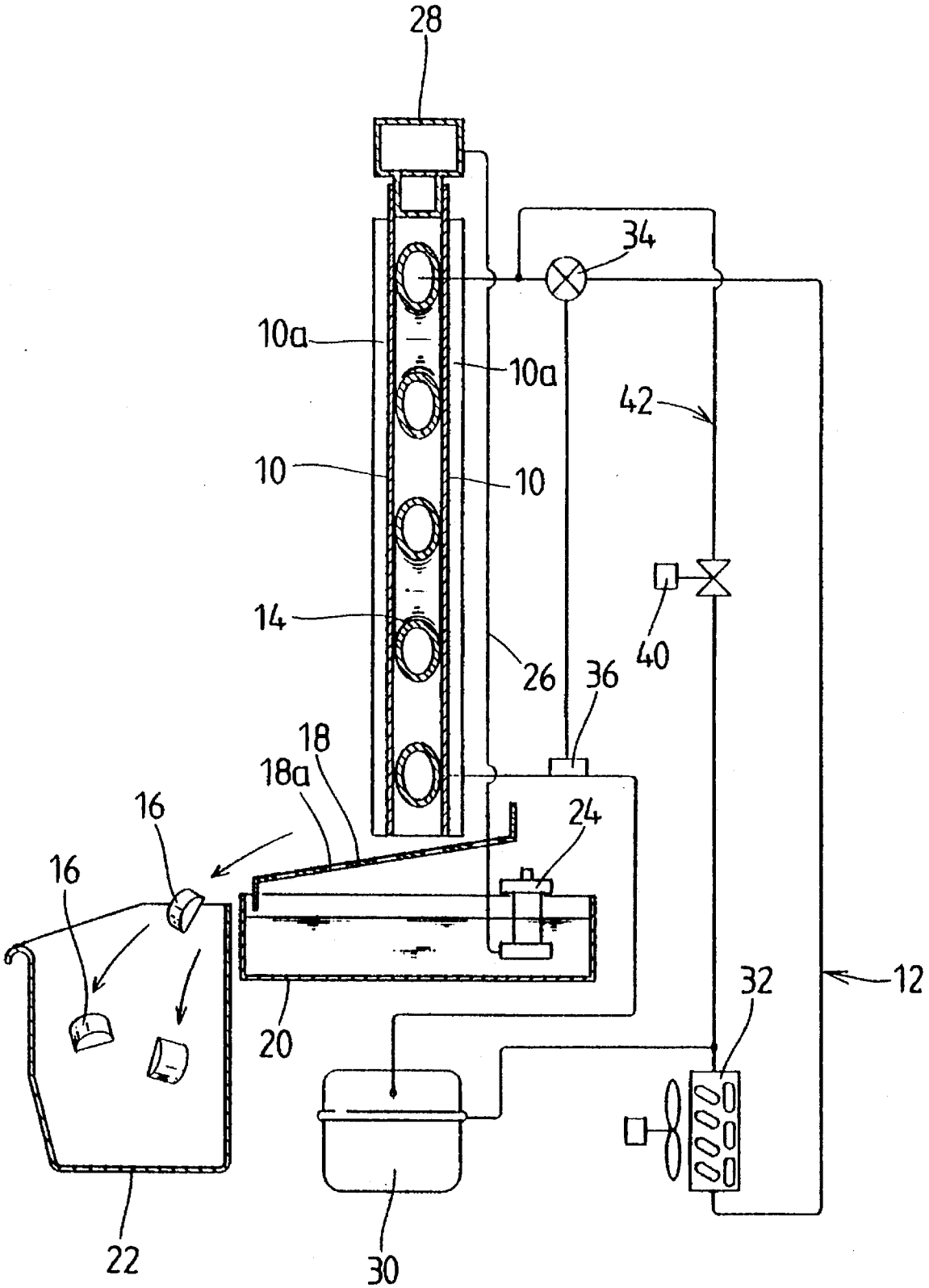
FIG. 3 shows schematically a constitution of a flow-down system automatic ice making machine in which ice pieces are formed by sprinkling water to be frozen onto ice making plates standing perpendicularly.
Figure 4:
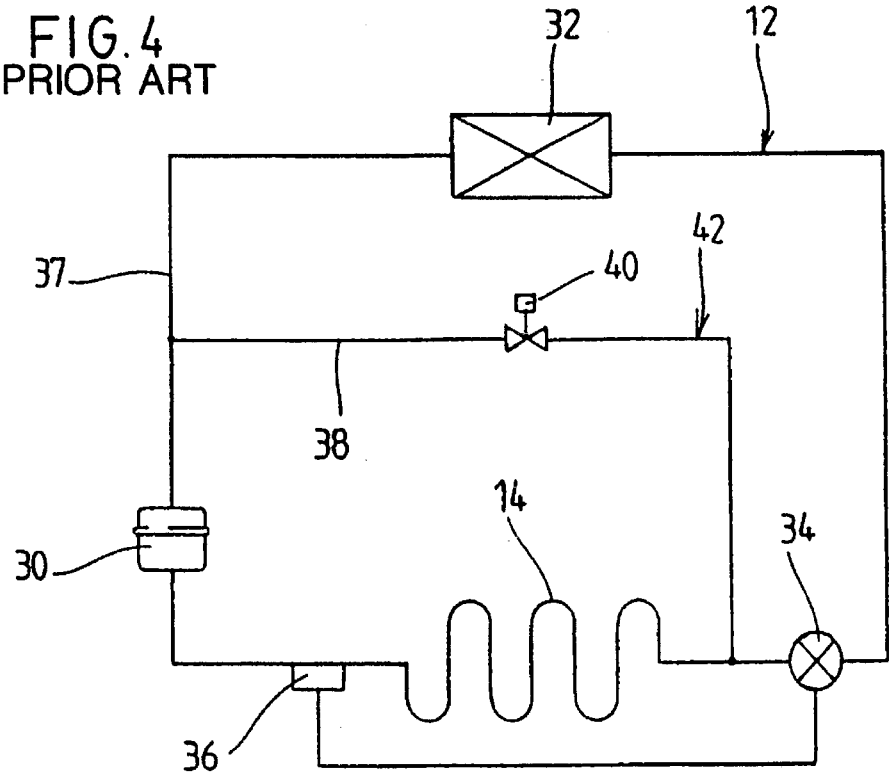
FIG. 4 PRIOR ART
FIG. 4 shows schematically a constitution of the prior art freezing circuit to be suitably employed in the automatic ice making machine shown in FIG. 3.

The refrigerant circuit for ice making machines and the like according to this invention will be described below by way of preferred embodiments referring to the attached drawings. It should be appreciated that the members similar to those already described with respect to the freezing circuit and the hot gas circuit referring to FIG. 5 shall be denoted with the same reference numbers, and detailed description thereof will be omitted. While FIG. 1 shows a refrigerant circuit according to a preferred embodiment of the invention, which can be employed in the flow-down system ice making machine described referring to FIG. 3, this circuit can also be employed generally in the freezers where defrosting is achieved by evaporators using a hot gas.

Figure 1:
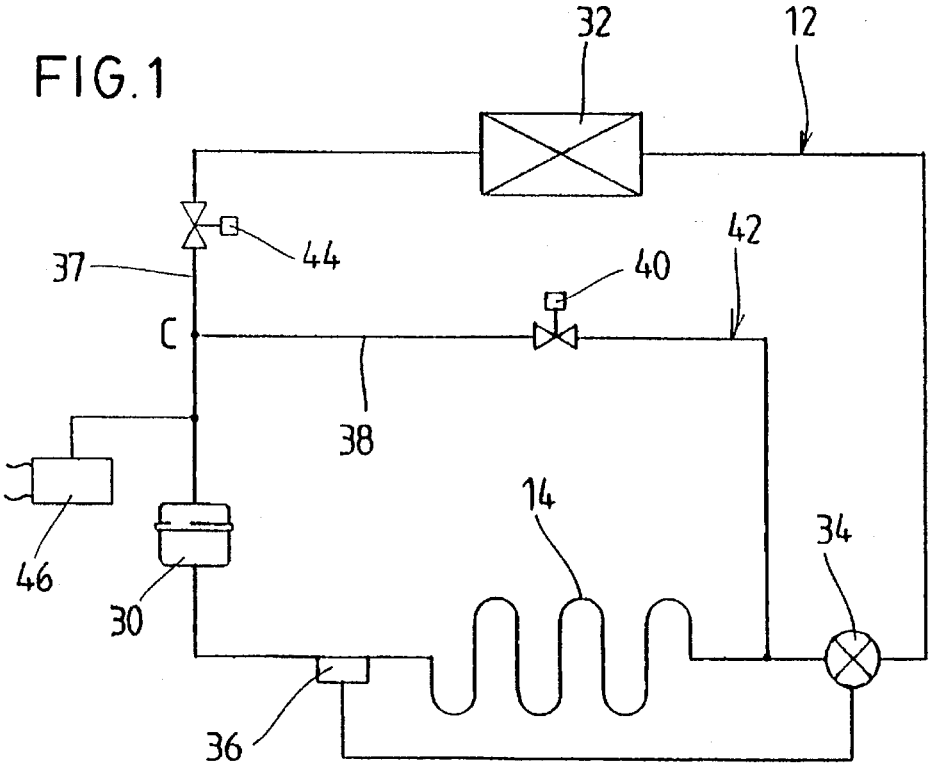
FIG. 1 shows schematically a constitution of the refrigerant circuit according to a preferred embodiment of the invention.
Figure 5:
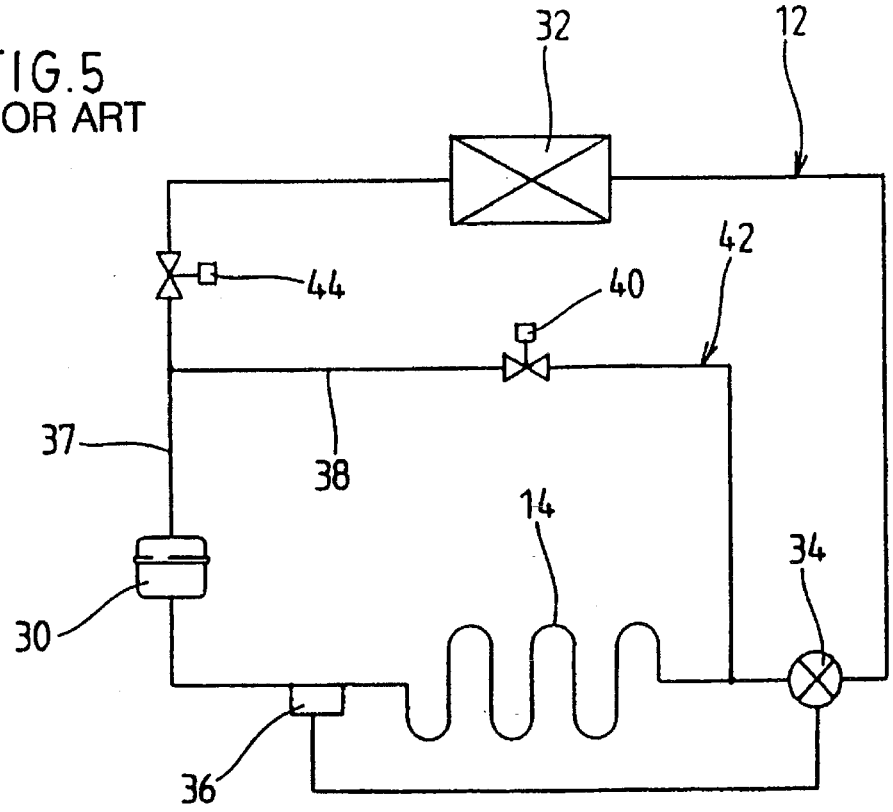
FIG. 5 PRIOR ART
FIG. 5 shows schematically a constitution of another embodiment of the prior art freezing circuit.

The refrigerant circuit shown in FIG. 1 is substantially the same as that described referring to FIG. 5, and the difference is that a pressure switch 46 is provided between the compressor 30 and the solenoid valve 44. More specifically, in the refrigerant circuit according to the preferred embodiment, the pressure switch 46 is interposed at a position upstream (on the compressor (30) side), with respect to the flow direction of the refrigerant, than the junction C of the pipe 37 locating on the outlet side of the compressor 30 and the pipe 38 of the hot gas circuit 42. The pressure switch 46 is designed to perform control of opening the solenoid valve 44, whenever it detects that the pressure on the outlet side of the compressor 30 is reaching or exceeding a preset level under the state where the high-pressure and high-temperature refrigerant delivered from the compressor 30 is circulated through the hot gas circuit 42 after the operation mode of the ice making machine is switched to the ice releasing operation to close the solenoid valve 44. Incidentally, the pressure level of the pressure switch 46 is preset to a value which does not interfere with efficient running of the compressor 30.

Namely, when the operation mode is switched from the freezing operation to the ice releasing operation in the above-described refrigerant circuit, the hot gas valve 40 is let open and the solenoid valve 44 is closed to interrupt circulation of the refrigerant through the freezing circuit 12 and to let the hot gas to circulate through the hot gas circuit 42. Thus, the ice making plates 10 attached to the evaporator 14 are heated, and the adhesion of the ice pieces 16 formed on the ice making plates 10 is released to allow them to drop by their own weight. It should be noted here that the hot gas delivered from the compressor 30 during the ice releasing operation is entirely fed to the hot gas circuit 42, so that no stagnation, as described above, occurs in the freezing circuit 12. Besides, not only drop in the ice releasing performance can be prevented, but also the time required for the ice releasing operation can be reduced, enabling secured ice releasing.

Upon detection of the preset pressure level by the pressure switch 46 after the ice releasing operation is started, the solenoid valve 44 is let open. Thus, a portion of the hot gas delivered from the compressor 30 is allowed to flow into the freezing circuit 12 to lower the pressure on the outlet side of the compressor 30. Consequently, reduction in the performance of the compressor 30 or accidents such as burning and damage thereof due to the overload applied thereto can be prevented. Incidentally, if the pressure on the outlet side of the compressor 30 is dropped to a predetermined level due to the flowing of the hot gas into the freezing circuit 12, the pressure switch 46 detects such drop and closes the solenoid valve 44, whereby to prevent lowering in the ice releasing performance.

Figure 2:
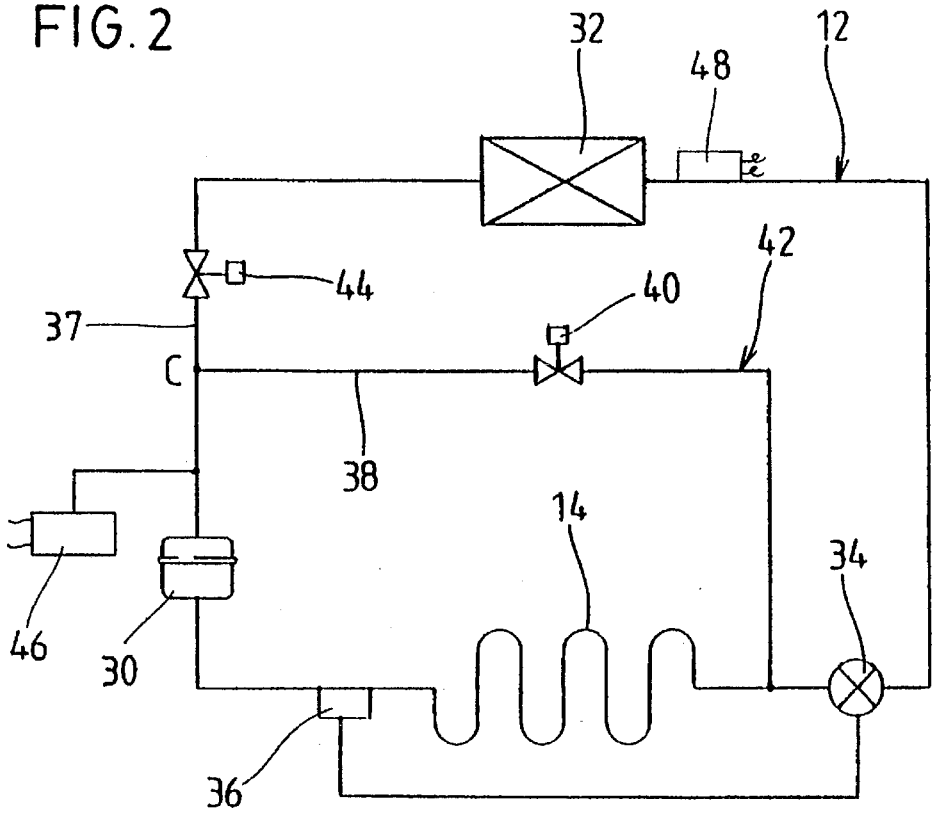
FIG. 2 shows schematically a constitution of the refrigerant circuit according to another embodiment of the invention.

It should be noted here that when the ambient temperature is high like in the summer, a very high ice releasing performance is not required. On the contrary, when the ambient temperature is low, the ice releasing performance becomes often insufficient. Accordingly, when the ambient temperature is high (at high temperatures), the solenoid valve 44 is controlled to be open even during the ice releasing operation; whereas when the ambient temperature is low (at low temperatures), the solenoid valve 44 is controlled to be closed during the ice releasing operation. Thus, ice pieces can efficiently be released whether it is a high temperature or a low temperature. Therefore, it is recommended to dispose a temperature sensing means 48 such as a thermostat on the outlet side of the condenser 32, as shown in FIG. 2, so as to perform control of closing the solenoid valve 44, only when the operation mode is switched to the ice releasing operation upon detection of the present low temperature level by the temperature sensing means 48. Incidentally, the opening and closing of the solenoid valve 44 when the operation mode is switched to the ice releasing operation may also be adapted to be controlled by detecting the high pressure of the condenser 32.

It has been found based on experiments and experience that the ice releasing operation at low ambient temperatures can be performed well by circulating the hot gas in a large amount at the initial and intermediate stages of ice releasing operation, and in a small amount at the final stage. Therefore, the solenoid valve 44 may be controlled to be let open using, for example, a timer provided in a control circuit (not shown) after passage of a predetermined time from the switching to the ice releasing operation so as to reduce the amount of the hot gas to be circulated through the hot gas circuit 42 by allowing a portion of the hot gas to flow into the freezing circuit 12. Incidentally, since the temperature of the refrigerant and that of the pipe 37 change as the pressure on the outlet side of the compressor 30 changes, a temperature detecting means can be disposed to the pipe 37 so as to allow the detecting means to detect such temperature change and achieve control of opening the solenoid valve 44.

What is claimed is:

1. A refrigerant circuit for an ice making machine, said circuit comprising:

a refrigerant circuit in which a high-pressure and high-temperature vaporized refrigerant obtained after compression in a compressor is fed through a solenoid valve to a condenser, the refrigerant condensed to be liquefied in said condenser is then fed to an expansion means, the refrigerant expanded to be vaporized through said expansion means is further fed to an evaporator, and the vaporized refrigerant heated through heat exchange in said evaporator is fed back to said compressor; and a hot gas circuit which bypasses said high-pressure and high-temperature vaporized refrigerant fed from said compressor to said evaporator through a hot gas valve so as to achieve ice releasing at said evaporator;

said solenoid valve and said hot gas valve being designed to be let open and closed, respectively, during the freezing operation and to be closed and let open, respectively, when the operation mode is switched to the ice releasing operation, wherein a pressure detecting means is provided in a refrigerant circulation line which connects said compressor and said solenoid valve; and after having been switched to an ice releasing operation, said pressure detecting means opens said solenoid valve by detecting that a pressure of said high-pressure and high-temperature vaporized refrigerant, which is delivered from said compressor, has reached a preset level so as to prevent the rise of pressure of said refrigerant on an outlet side of said compressor, and said pressure detecting means further closes said solenoid valve by detecting a drop of pressure of said refrigerant to a predetermined level on said outlet side of said compressor.

2. The refrigerant circuit for an ice making machine according to claim 1, wherein a temperature sensing means is disposed in a refrigerant circulating line which is connected to a refrigerant outlet side of said condenser; and said solenoid is closed only after said temperature sensing means detects a preset low temperature and said ice releasing operation is started, and said solenoid is opened when said pressure detecting switch detects that a pressure of said high-pressure and high-temperature evaporated refrigerant delivered from said compressor reaches a preset pressure.

* * * * *